US009225076B2

(12) United States Patent
Froeschl

(10) Patent No.: US 9,225,076 B2
(45) Date of Patent: Dec. 29, 2015

(54) CONNECTION ELEMENT FOR AN ELECTRICAL CONDUCTOR

(75) Inventor: Karl Franz Froeschl, Herrnbaumgarten (AT)

(73) Assignee: GEBAUER & GRILLER KABELWERKE GESELLSCHAFT M.B.H., Vienna (AT)

( * ) Notice: Subject to any disclaimer, the term of this patent is extended or adjusted under 35 U.S.C. 154(b) by 103 days.

(21) Appl. No.: 13/879,449

(22) PCT Filed: Oct. 6, 2011

(86) PCT No.: PCT/AT2011/000417

§ 371 (c)(1),
(2), (4) Date: Apr. 15, 2013

(87) PCT Pub. No.: WO2012/048354

PCT Pub. Date: Apr. 19, 2012

(65) Prior Publication Data

US 2013/0203303 A1 Aug. 8, 2013

(30) Foreign Application Priority Data

Oct. 13, 2010 (AT) ..... 1702/2010

(51) Int. Cl.

| | |
|---|---|
| ***H01R 4/02*** | (2006.01) |
| ***H01R 4/18*** | (2006.01) |
| ***H01R 4/20*** | (2006.01) |
| ***H01R 4/62*** | (2006.01) |

(52) U.S. Cl.

CPC ..... *H01R 4/02* (2013.01); *H01R 4/023* (2013.01); *H01R 4/187* (2013.01); *H01R 4/20* (2013.01); *H01R 4/625* (2013.01)

(58) Field of Classification Search

CPC ..... H01R 4/02; H01R 4/023; H01R 4/625; H01R 4/20; H01R 4/188

USPC ..... 439/874, 430, 730, 880

See application file for complete search history.

(56) References Cited

U.S. PATENT DOCUMENTS

| | | | | | |
|---|---|---|---|---|---|
| 2,677,746 | A | * | 5/1954 | Duch et al. | 219/104 |
| 2,721,986 | A | * | 10/1955 | Badeau | 439/730 |
| 2,769,965 | A | * | 11/1956 | Frey | 439/730 |
| 2,799,840 | A | * | 7/1957 | Barnes | 439/880 |
| 2,939,905 | A | | 6/1960 | Canfield | |
| 3,566,008 | A | * | 2/1971 | Ettlinger et al. | 174/94 R |
| 3,656,092 | A | * | 4/1972 | Swengel et al. | 439/730 |
| 3,728,781 | A | * | 4/1973 | Curtis et al. | 228/113 |
| 4,196,960 | A | * | 4/1980 | Gelfand | 439/874 |
| 4,317,277 | A | * | 3/1982 | Bennett et al. | 29/860 |

(Continued)

FOREIGN PATENT DOCUMENTS

| | | | |
|---|---|---|---|
| AT | 008 315 | U1 | 5/2006 |
| DE | 954805 | C | 12/1956 |

(Continued)

*Primary Examiner* — Hae Moon Hyeon

(74) *Attorney, Agent, or Firm* — Laurence Greenberg; Werner Stemer; Ralph Locher

(57) ABSTRACT

A connection element for an electrical conductor contains a first section to be connected to another component, and a second section having a front surface to be welded to an electrical conductor. The front surface has a three-dimensional form raised in a central region in relation to an edge region surrounding the central region. The connection element is hollow in the region of the front surface.

22 Claims, 2 Drawing Sheets

(56) References Cited

U.S. PATENT DOCUMENTS

| | | | | |
|---|---|---|---|---|
| 4,927,372 | A * | 5/1990 | Collier | 439/83 |
| 5,971,819 | A * | 10/1999 | Prat et al. | 439/874 |
| 6,359,332 | B2 * | 3/2002 | Shiraishi | 257/697 |
| 6,623,283 | B1 * | 9/2003 | Torigian et al. | 439/83 |
| 7,485,017 | B2 * | 2/2009 | Pang et al. | 439/876 |
| 7,537,464 | B2 * | 5/2009 | Brandenburg et al. | 439/76.1 |
| 8,840,437 | B2 * | 9/2014 | Hentschel et al. | 439/874 |
| 2002/0142677 | A1 * | 10/2002 | Hosaka et al. | 439/874 |
| 2006/0292922 | A1 | 12/2006 | Froschl | |
| 2008/0009155 | A1 * | 1/2008 | Ide et al. | 439/83 |
| 2009/0249616 | A1 | 10/2009 | Froeschl | |
| 2011/0177727 | A1 * | 7/2011 | Zhao | 439/874 |

FOREIGN PATENT DOCUMENTS

| | | | |
|---|---|---|---|
| DE | 4328770 | A1 | 3/1994 |
| DE | 103 46 160 | B3 | 7/2005 |
| DE | 10 2004 050 676 | A1 | 4/2006 |
| EP | 2 131 448 | A1 | 12/2009 |
| JP | 2003-338350 | A | 11/2003 |
| WO | 2004/047227 | A1 | 6/2004 |
| WO | 2007/140489 | A1 | 12/2007 |

* cited by examiner

CONNECTION ELEMENT FOR AN ELECTRICAL CONDUCTOR

BACKGROUND OF THE INVENTION

Field of the Invention

The invention relates to a connection element for an electrical conductor having a first section, which is intended to be connected to a further component, and a second section with an end face which is intended to be welded to the conductor, wherein the end face has a three-dimensional shape which, in a central region, is elevated in relation to an edge region which surrounds the central region.

The invention also relates to an electrical connection having a connection element and an electrical conductor which is welded to said connection element, wherein the connection element has a first section, which is intended to be connected to a further component, and a second section with an end face which is welded to the conductor, wherein the end face has a three-dimensional shape which, in a central region, is elevated in relation to an edge region which surrounds the central region.

Electrical cables are connected to other electrical components, for example batteries in motor vehicles, with the aid of connection elements. The contact area is essential to the quality of an electrically conductive connection between a connection element and an electrical line. The larger the contact area and the better the connection between the connection element and the cable, the lower the specific current load and the resulting contact resistance.

A connection element of the kind cited in the introductory part and an electrical connection which is established with it by resistance welding is known from DE 954 805 C. Said document discloses providing a cable shoe with a projection which is pointed or is provided with a sharpened edge for the purpose of increasing the resistance at the contact point with the conductor which is intended to be connected. Said document also discloses dividing the pointed end of the projection, or the end of the projection which is of reduced cross section, using a plurality of incisions in such a way that, firstly, the surface is increased and, secondly, a number of further points or edges is produced, these being drawn into the welding zone when the cable shoe projection is combined with the conductor which is intended to be welded, during the course of the resistance welding. However, since the current searches for the path of least electrical resistance, the majority of the current will flow through the central region of the cable shoe projection, the conductor and/or the cable shoe beginning to melt in the region of said cable shoe projection, with the result that the flow of current through the edge region of the cable shoe projection and of the conductor is minimized and consequently reliable welding of the cable shoe projection to the conductor in the edge region can no longer be sufficiently good.

BRIEF SUMMARY OF THE INVENTION

Therefore, the invention is based on the object of improving a connection element and an electrical connection of the kind cited in the introductory part such that the connection element is reliably welded to the conductor over the entire end face or contact area.

In a connection element of the kind cited in the introductory part, this object is achieved in that the connection element is hollow in the region of the end face.

This object is also achieved by an electrical connection of the kind cited in the introductory part which is characterized in that the connection element is designed as claimed.

Since the connection element is hollow in the region of the end face, the current can flow, as in the prior art, not only through the central region of the connection element but rather is forced to flow through the end-side wall of the connection element from the outside to the inside in the direction of the central region, as a result of which the edge region of the end face is also heated by the current and there is also a sufficiently large flow of current from the edge region of the connection element into the edge region of the conductor, as a result of which this is also melted to a sufficient extent in the edge region and fused to the connection element.

In a preferred embodiment of the invention, the contact area is in the form of a spherical cap or a segment of an ellipsoid of revolution. In alternative embodiments, the contact area is, for example, conical or pyramidal, wherein the tip can be rounded in both cases.

In a variant which is particularly simple to produce, the second section of the connection element is formed from a flat section by stamping or deep-drawing.

In the connection according to the invention, the electrical conductor can be surrounded by a sleeve in the region of its connection point to the end face in a manner which is known per se. The sleeve, which is preferably likewise welded to the connection element in the case of the invention, reinforces the connection region between the connection element and the electrical conductor and also that region of the electrical conductor which directly adjoins the connecting point and therefore provides protection, in particular protection against bending which makes it possible to subject the connection to mechanical loading.

In the case of the invention, it is further preferred when the sleeve is shrunk or pressed onto the conductor. However, this embodiment is particularly, but not only, preferred when the electrical conductor is composed of individual wires or litz wires which are stabilized by the pressed-on or shrunk-on sleeve and as a result cannot yield during the welding process.

When the second section has a region which adjoins the end face and has a cylindrical outer face, this cylindrical section then constitutes an additional, stabilizing section for the sleeve, which section further improves the protection of the connection against bending.

In a particularly preferred embodiment, the connection element according to the invention is characterized in that a flange adjoins the region with the cylindrical outer face. The sleeve can likewise be welded to said flange if required.

The connection element according to the invention can, as is known from the prior art, be composed of copper or a copper alloy. In the case of the invention, the sleeve can also be composed of copper, a copper alloy, aluminum or an aluminum alloy, as can the electrical conductor. However, a preferred embodiment comprises a connection element which is composed of copper or a copper alloy, and an electrical conductor and a sleeve which are composed of aluminum or an aluminum alloy.

In order to, as far as possible, prevent stress corrosion between individual parts which are composed of different materials in the case of the connection element according to the invention, the sleeve can be coated, at least on its inner side, with a material which is situated between the material of the sleeve and the material of the electrical conductor in the electrochemical series.

Further features and advantages of the invention can be found in the following description of a preferred exemplary embodiment of the invention with reference to the drawings, in which:

DESCRIPTION OF THE INVENTION

Figure 1:
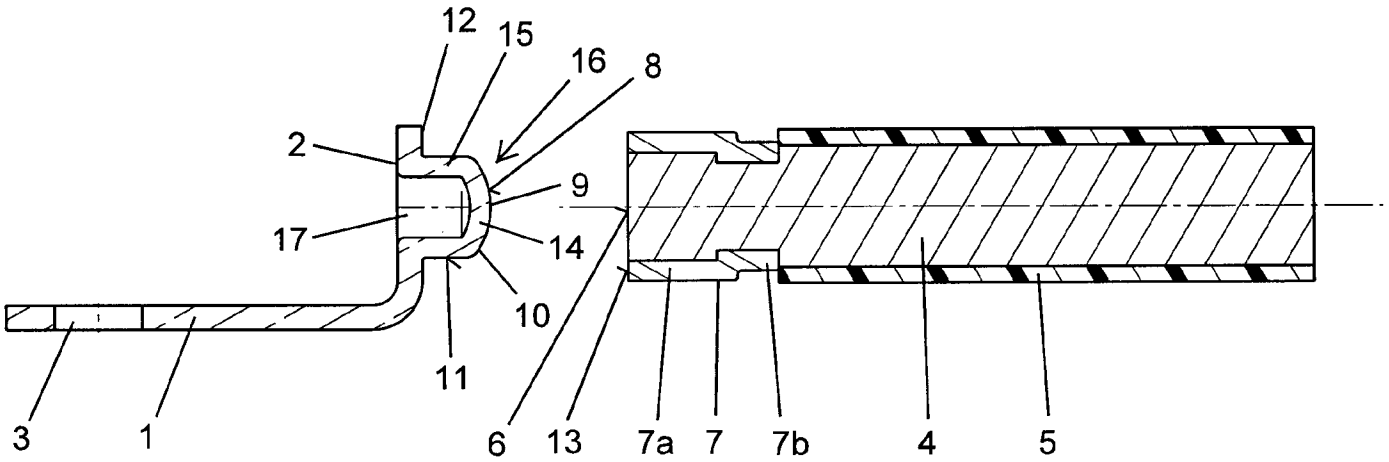
FIG. 1 shows a connection element according to the invention before it is connected to an electrical conductor.

The drawings show an embodiment of a connection element according to the invention which substantially comprises a first section 1 and a second section 2 which is arranged approximately at a right angle to the first section 1. The first section 1 has an opening 3 through which a screw—not illustrated—can be inserted in order to connect the connection element according to the invention to another electrical component, for example to a vehicle battery.

The second section 2 serves to connect the connection element to an electrical conductor 4 which can be a solid conductor or can comprise a plurality of wires or litz wires. The electrical conductor 4 is surrounded by an insulation 5 in a manner which is known per se, said insulation ending at a certain distance in front of the end 6 of the electrical conductor. In the illustrated exemplary embodiment, the electrical conductor 4 is surrounded by a sleeve 7 in the region without the insulation 5 and is, for example, mechanically pressed by said sleeve. When the sleeve 7 and the electrical conductor 4 are composed of different materials, for example the electrical conductor is composed of aluminum or an aluminum alloy and the sleeve 7 is composed of copper or a copper alloy, a coating, for example based on tin or nickel, which lies between said different materials in the electrochemical series can be applied to the inner side of the sleeve.

The sleeve 7 has a front section 7*a* which is adjacent to the end 6 and terminates, preferably flush, with said end, and has a rear section 7*b* which is remote from the end 6, the insulation 5 adjoining said rear section. The rear section 7*b* has an inside diameter which is smaller than the inside diameter of the front section 7*a*. The same applies for the outside diameter of these two sections. The section of the conductor 4 which is situated beneath the rear section 7*b* is compressed to a greater extent by said rear section than in that region of the conductor 4 which is situated beneath the front section 7*a*, as a result of which the conductor 4 is supported from the rear while the connection element is pressed against the end 6 during welding.

The second section 2 has a projection 16 with a contact area or end face 8 with a three-dimensional shape which, in a central region 9, is elevated in relation to an edge region 10 which surrounds the central region 9. In the illustrated exemplary embodiment, the end face 8 is approximately in the form of a spherical cap with a constant radius of curvature. However, it is also possible within the scope of the invention to use other faces in which, for example, the radius of curvature in the central region 9 is greater than in the edge region 10, or vice versa, as would be the case, for example, in a segment of an ellipsoid of revolution.

A section 15 with a cylindrical outer face 11 adjoins the end face 8 and a flange 12, to which an end face 13 of the sleeve 7 is welded, in turn adjoins said cylindrical outer face.

The connection element or its projection 16 at the second section 2 is hollow in the region of the end face 8, as a result of which a thin wall 14 is formed, the wall thickness of said wall preferably being the same in the entire region beneath the end face 8. However, it is likewise possible for the wall thickness to increase or decrease from the edge region 10 to the central region 9. A wall thickness which increases in the direction of the central region 9 is advantageous, for example, when the wall 14 is also at least partially melted in the central region of the end face 8 during the welding process since this region is subjected to the action of the welding process for the longest period of time.

On account of the second section 2 having a hollow space 17, the section 15 with the cylindrical outer face 11 also has a defined wall thickness which preferably corresponds to the wall thickness in the region of the end face 8. This internal hollow shape of the second section 2 of the connection element can be produced, for example, by plastic deformation of a second section 2, which was originally flat, with the aid of a stamp or punch.

The connection element according to the invention is connected to the electrical conductor 4 of the cable, for example, such that the central region 9 initially bears against the end 6 of the electrical conductor 4 and a voltage is applied to the connection element and the electrical conductor 4. At the same time, the connection element and the electrical conductor 4 are pressed against one another.

In this case, the material of the electrical conductor 4 is preferably selected in relation to the material of the connection element such that the electrical conductor 4 begins to melt in the region of its end 6 but the connection element does not, with the result that the central region 9 penetrates the melting electrical conductor 4 when the two parts are pressed together. Since the central region 9 projects in relation to the edge region 10, the molten mass of the electrical conductor 4 flows away toward the edge region 10 and beyond. Since the wall 14 has only a limited wall thickness, the electric current is forced to flow through the wall of the section 15 and the wall 14 from the outside to the inside in the direction of the central region 9, with the result that there is a sufficient degree of current flow in the edge region 10 too, and therefore, as soon as electrical contact is made with the electrical conductor 4 in the edge region 10 too, there is a sufficiently high current flow here in order to heat the electrical conductor 4 to its melting point in the edge region 10 or to ensure that molten mass which flows away from the central region 9 to the outside does not collect and/or solidify in the edge region 10. In this way, it is possible to ensure that the electrical conductor 4 is welded to the entire end face 8 over the full surface, the intermetal boundary layer having a uniform and very low thickness in this case.

Figure 2:
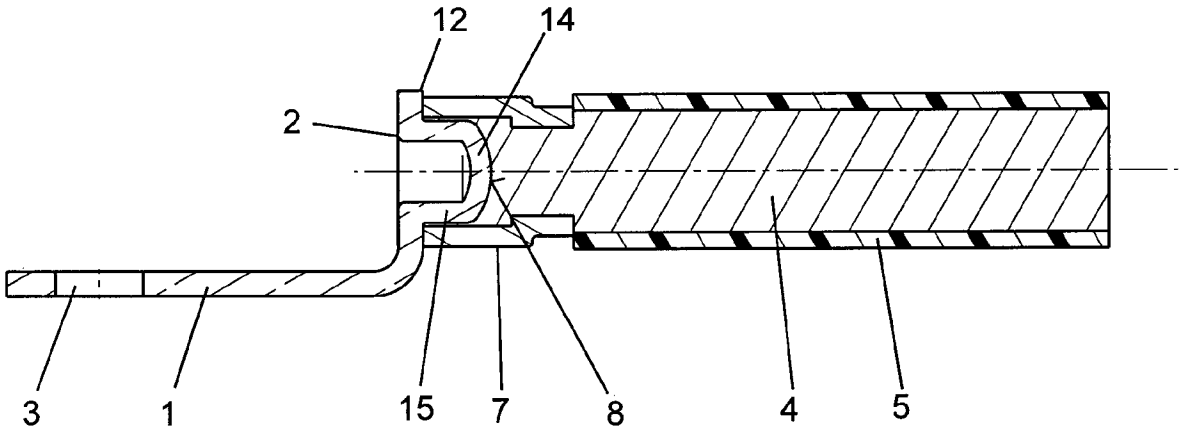
FIG. 2 shows the connection element according to the invention after it is connected to the electrical conductor.
Figure 3:
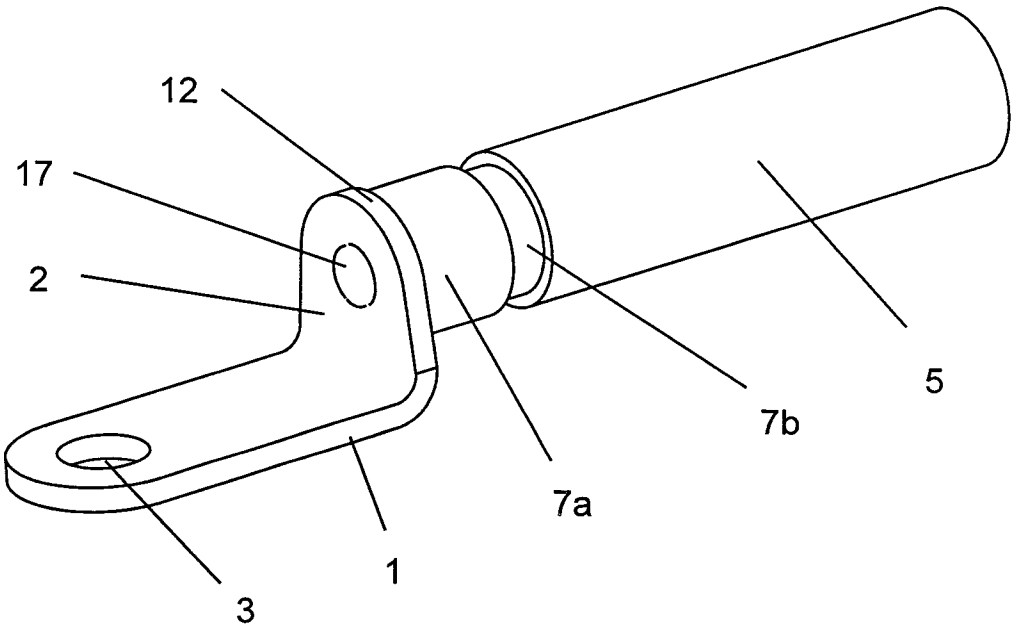
FIG. 3 shows an oblique view of the connection element according to the invention after it is connected to the electrical conductor.

The current flow is maintained until the position which is illustrated in FIG. 2 is reached, the connection element bearing, by way of its flange 12, against the end face 13 of the sleeve 7 and preferably the sleeve 7 likewise being welded at its end face 13 to the flange 12 in said position. The section 15 with the cylindrical outer face 11 provides interlocking stabilization between the connection element and the sleeve 7, wherein the molten mass which emerges through the gap between the cylindrical outer face 11 and the inner face of the front section 7*a* and later hardens performs a mechanically stable connection between the second section 2 of the connection element and the sleeve 7, said connection, apart from the electrical connection at the end face 8, also constituting an additional electrical connection between the electrical conductor 4 and the second section 2 via the sleeve 7. Since the current flow is also forced through the thin wall of the section 15, said wall is also heated and hardening of the molten mass in the gap is avoided, before the final welding position which is illustrated in FIG. 2 was reached.

The use of welding additives which are known for the materials which are intended to be used or to be connected is at the discretion of a person skilled in the art.

The invention claimed is:

1. A connection element for an electrical conductor, comprising:

a first section for connecting to a further component; and a second section having an end face to be welded to the electrical conductor, said end face having a three-dimensional shape with an edge region and a central region being elevated in relation to said edge region surrounding said central region;

a thin wall disposed beneath said end face, said second section having a hollow region formed therein beneath said thin wall and opposite said end face.

2. The connection element according to claim 1, wherein said end face has said three-dimensional shape being selected from the group consisting of a spherical cap shape and a segment of an ellipsoid of revolution shape.

3. The connection element according to claim 1, wherein said end face is one of conical or pyramidal.

4. The connection element according to claim 3, wherein said end face has a rounded tip.

5. The connection element according to claim 1, wherein said second section has a projection with a wall, said end face is disposed on said wall on said projection.

6. The connection element according to claim 1, wherein said second section has a region adjoining said end face, said region having a cylindrical outer face.

7. The connection element according to claim 6, wherein said second section has a flange adjoining said region with said cylindrical outer face.

8. The connection element according to claim 6, wherein said end face has a wall thickness and said region adjoining said end face has a wall thickness that is constant.

9. The connection element according to claim 1, wherein said second section is formed from a flat section by stamping or deep-drawing.

10. The connection element according to claim 1, wherein said first and second sections are formed from a material selected from the group consisting of copper and copper alloys.

11. The connection element according to claim 1, wherein said end face has a wall thickness that is constant.

12. An electrical connection, comprising:

a connection element having a first section to be connected to a further component and a second section with an end face, said end face having a three-dimensional shape with an edge region and a central region, being elevated in relation to said edge region surrounding said central region;

a thin wall disposed beneath said end face, said second section having a hollow region formed therein beneath said thin wall and opposite said end face; and an electrical conductor welded to said end face.

13. The electrical connection according to claim 12, further comprising a sleeve surrounding said electrical conductor at an end which is connected to said connection element.

14. The electrical connection according to claim 13, wherein said sleeve is shrunk or pressed onto said electrical conductor.

15. The electrical connection according to claim 13, wherein said sleeve has a front section which is adjacent to said connection element, and a rear section which is remote from said connection element, and in that an inside diameter of said front section is larger than an inside diameter of said rear section.

16. The electrical connection according to claim 13, wherein said sleeve is welded to said edge region.

17. The electrical connection according to claim 16, wherein said sleeve is welded to said edge region by resistance welding.

18. The electrical connection according to claim 13, wherein said sleeve is composed of a material selected from the group consisting of copper, a copper alloy, aluminum, and an aluminum alloy.

19. The electrical connection according to claim 13, wherein said sleeve is coated, on an inner side, with a material which is situated between a material of said sleeve and a material of said electrical conductor in a electrochemical series.

20. The electrical connection according to claim 12, wherein said electrical conductor is composed of a material selected from the group consisting of copper, a copper alloy, aluminum and an aluminum alloy.

21. The electrical connection according to claim 12, wherein said end face is a cap of said second section.

22. The electrical connection according to claim 12, wherein said end face is elevated in a direction towards the electrical conductor.

* * * * *